United States Patent [19]

Hasegawa et al.

[11] 4,244,402

[45] Jan. 13, 1981

[54] DEVICE FOR INSERTING A WEFT YARN IN JET OPERATED WEAVING MACHINES

[75] Inventors: Junzo Hasegawa, Obu; Kazunori Yoshida, Nagoya; Fuzio Suzuki, Toyoda; Hajime Suzuki, Anjo; Hiroshi Arakawa, Kariya; Akira Kobayashi, Obu; Akio Arakawa, Kariya; Munechika Yamazato, Toyota, all of Japan

[73] Assignees: Kabushiki Kaisha Toyoda Jidoshokki Seisakusho; Kabushiki Kaisha Toyota Chuo Kenkyusho, both of Aichi, Japan

[21] Appl. No.: 15,486

[22] Filed: Feb. 26, 1979

[30] Foreign Application Priority Data

Feb. 27, 1978 [JP] Japan ..... 53/022445

[51] Int. Cl.[3] ..... D03D 47/28

[52] U.S. Cl. ..... 139/435

[58] Field of Search ..... 139/435, 188

[56] References Cited

U.S. PATENT DOCUMENTS

| | | | |
|---|---|---|---|
| 3,818,952 | 6/1974 | Vermealen et al. | 139/435 |
| 3,821,972 | 7/1974 | Suaty et al. | 139/435 |
| 3,901,286 | 8/1975 | Vermeulen et al. | 139/435 |
| 4,116,243 | 9/1978 | Vettiger | 139/435 |
| 4,127,148 | 11/1978 | Larmit | 139/435 |

*Primary Examiner*—Henry Jaudon

*Attorney, Agent, or Firm*—Burgess, Ryan and Wayne

[57] ABSTRACT

A device for inserting a weft yarn in a shed of the jet operated weaving machine provided with a control means for controlling the carrying action of the weft yarn, which is carried by a plurality of pressure fluid flows through a guiding channel formed in a comb arranged in parallel condition to a reed. The comb comprises a plurality of guiding plates and an air escaping passage formed between every two adjacent guide plates in such a condition that the quantity of the escaping air which flows through each escaping passage is maximum at a predetermined portion of each escaping passage. The above-mentioned control means comprises the above-mentioned escaping passages.

20 Claims, 12 Drawing Figures

DEVICE FOR INSERTING A WEFT YARN IN JET OPERATED WEAVING MACHINES

SUMMARY OF THE INVENTION

The present invention relates to a device for inserting a weft yarn in jet operated weaving machines, more particularly a device for inserting a weft yarn in a shed while carrying the weft yarn by a controlled fluid stream in a guiding channel formed in the shed.

In general, the conventional jet operated weaving machine can be clasified into the following two types. The first type is a jet operated weaving machine provided with a particular reed wherein each individual blade thereof is provided with a recess portion open toward the side of cloth-fell and a guiding channel is formed by the recess portions of the blades which are aligned along the longitudinal direction of the reed, so that a weft yarn introduced into the shed is carried by a fluid jet stream guided by the above-mentioned guiding channel. The jet operated weaving machine disclosed in U.S. Pat. No. 3,818,952 belongs to the above-mentioned first type. The second type of jet operated weaving machine is provided with a means for guiding a weft yarn introduced into the shed and a fluid jet stream or streams carrying the weft yarn along the direction for inserting the weft yarn through the shed, and the guiding means is disposed on the slay at a position between the reed and the cloth-fell. The jet operated weaving machines disclosed in U.S. Pat No. 3,065,770 and U.S. Pat No. 3,821,972 belong to the above-mentioned second type.

For the sake of an easy understanding of the present invention, the above-mentioned direction for inserting the weft yarn is hereinafter refered to as a filing direction.

In the jet operated weaving machine of the first type, the modified read has two functions, that is, a function to guide a weft yarn introduced into a shed and carry by a fluid jet stream or streams toward the filing direction and another function to beat up the thus inserted weft yarn to the cloth fell. However, as it is well known, since the primary function of the reed is to beat up the weft yarn inserted into the shed to the cloth fell in streightened condition, characteristics such as thickness, density and the mechanical properties, ie, resilient property, of the blades, are scientifically or customarily chosen so as to fit for the yarn utilized for weaving an intended cloth. Consequently, it is almost impossible to design the construction, and shape of the blade without taking the above-mentioned desired characteristics into consideration. In other words, there are restrictions, in designing the blade of the above-mentioned modified reed. For example, even if it is desirable to increase the depth of the above-mentioned recess formed in each blade or to change the density of blades so as to create an effective guiding channel for carrying a weft yarn by a jet fluid stream, such modifications are restricted, because the beating up function of the reed must be the primarily consideration. Further, if it is necessary to change the reed because of changing the yarn for weaving an intended woven cloth, it is also necessary to change the condition of the above-mentioned recess formed in each blade, and the selection of blades is very difficult. In addition to the above-mentioned problems, the conventional jet operated weaving machine of the first type has serious drawbacks that the modified reed impacts against a pair of temples which are disposed at the respective positions adjacent to the cloth fell. If, the disposition of the temples is changed to a position where the reed can not contact the temples, or those temples are omitted from the weaving machine, the quality of the woven cloth becomes poor. As mentioned above, the above-mentioned jet operated weaving machine of the first type has many drawbacks.

The jet operated weaving machine the second type does not have the above-mentioned drawbacks of the jet operated weaving machine of the first type. This is because this weaving machine utilizes the traditional reed and a particular guide means for guiding a weft yarn introduced into a shed by a fluid jet stream introduced into a guiding channel in the shed. It may be understood that the intention of utilizing the guide means independently of the reed is based upon the following two requirements, that is, a requirement for carrying a weft yarn introduced into a shed by a fluid stream or streams having sufficiently strong propelling force until the completion of the weft insertion through the shed, and a requirement for a distinct increase in the productive efficiency of the weaving machine. To satisfy the above-mentioned requirements, in the jet operated weaving machine disclosed in U.S. Pat. No. 3,065,770, a comb, comprising a row of aligned guide members rigidly mounted on a slay at a position between the reed and the cloth-fell, is utilized. Each guide member is provided with an inner opening and two end portions with ends forming a narrow gap extending from the inner opening to the outside thereof. Therefore, the inner openings of the aligned guide members form a guiding channel for guiding an air jet stream and a weft yarn carried by this air jet stream. Since the above-mentioned guiding channel formed by the inner openings of the aligned guide members has a function similar to a tunnel, the above-mentioned first requirement can be considerably satisfied. However, since a plurality of guide members are utilized for forming the guiding channel, in other words, the guiding channel is formed by a plurality of inner openings of the guide members and a plurality of intervened spaces between every two adjacent guide members, the guiding channel is not a continuous channel and, therefore it is impossible to prevent the possible disorder of the jet air stream in the guiding channel. Since the running motion of a weft yarn introduced into the guiding channel is not mechanically controlled, in other words, is controlled by the jet air stream in the guiding channel, it is impossible to prevent the weft yarn from fluctuating toward the inside wall of the inner opening of each guide member. As a result, the weft yarn does not move in a streightened condition in the guiding channel, that is, the weft yarn possibly runs, for example, in a zig-zag condition in the shed. Further, if the weft yarn contacts the inside wall of the inner opening of the guide members, the carrying speed of the weft yarn by the fluid jet is lowered remarkably. To overcome the above-mentioned possible problem, it is important to dispose the guide members on the slay with high precision. Further, in this jet operated weaving machine, since the guiding channel is covered by the body of the guide member, it is very difficult to observe the weft yarn in the guiding channel. Therefore, if a part of the weft yarn introduced into the guiding channel is caught by some part of a guide member, it is very difficult to observe and rectify such a condition quickly. As mentioned above, the jet operated weaving machine provided with such guide members still has various problems which must be solved. The jet operated weaving machine disclosed in U.S. Pat. No. 3,821,972 was developed to satisfy the above-mentioned requirements by utilizing a comb composed of a plurality of guide plates disposed at a position between the reed and the cloth-fell in an aligned condition to the longitudinal direction of the reed, and a plurality of auxiliary nozzles disposed at the respective positions between the comb and the reed in the same aligned condition as the comb. Each guide plate is provided with a wide opening toward the reed so that a guiding channel is formed by the above-mentioned openings of the guide plates. Each auxiliary nozzle is connected to a supply source of pressured air and is provided with an aperture for jetting the compressed air toward a part of the guiding channel, so as to create an air stream flowing toward the filing direction. Therefore, it may be understood that, the above-mentioned guide plates have a function similar to the guiding function of the modified reed utilized for the jet operated weaving machine of the first type discussed hereinbefore.

Based on practical experience, the inventors of the present invention have known that the above-mentioned comb, composed of a plurality of guide plates, each having the opening to form the guiding channel, still has the following practical problems. That is, since the guiding channel is widely opened toward the reed, even though the possible catching of a weft yarn by the tip portion of any guide plate can be assureadly prevented, when the weft yarn moves out of the guiding channel for carrying out of the beating up operation of the reed, the jet stream ejected from any one of the auxiliary nozzles tends to diffuse to a space outside the guiding channel. As a result, it is impossible to create an effective function for guiding and carrying a weft yarn toward the filing direction, because the requirement to maintain strong propelling force of the air stream in the guiding channel and the requirement for carrying a weft yarn in a streightened condition toward the filing direction can not be fulfilled. Therefore, it is quite possible that a weft yarn introduced into the shed by a suitable means is made to pass through the guiding channel in a rather zig-zag condition, so that the weft yarn contacts the guide members or escapes from the guiding channel, if the above-mentioned diffusion of the air stream jetted from any one of the auxiliary nozzles is distinct. If such problem occurs, it is impossible to prevent the creation of improper insertion of a weft yarn through a shed. To prevent the possible creation of such trouble, it is very important to chose pertinent conditions related to number of auxiliary nozzles and the pressure condition of the air stream jetted from the auxiliary nozzles, in connection with the running speed of the weaving loom. Such conditions are not constant with respect to the kind of intended woven fabric for which the density of reed may be changed.

As mentioned above, the jet operated weaving machine of the above-mentioned types have the respective enumerated advantages, but they still have problems which must be solved. In other words, it may fairly be said that the basic problems regarding how to establish a stable carrying condition of a weft yarn by the fluid stream in the guiding channel when the weft yarn is inserting through the shed, and how to carry the weft yarn with a carrying speed which is sufficient to attain the desired high productivity of the weaving machine, can not be sufficiently solved by the known jet operated weaving machine. Therefore, it is the principal object of the present invention to provide a device for inserting a weft yarn through a shed formed in a jet operated weaving machine by which the problems remaining in the conventional jet operated weaving machine can be solved.

To attain the purpose of the present invention, in the jet operated weaving machine according to the present invention, which is provided with a reed for beating up a weft yarn inserted through a shed periodically, a slay for supporting the reed, and a main nozzle for picking up and carrying the weft yarn through at least a part of the length of the shed, a comb having a plurality of guide plates supported on the slay, and a plurality of auxiliary nozzles supported on the slay for directing a plurality of individual pressure fluid flows into a guiding channel formed by the comb, the carrying action of the weft yarn by the individual pressure fluid flows started from each of the auxiliary nozzles is controlled by a combination of a plurality of guide plates and corresponding the auxiliary nozzles with a predetermined number of guide plates cooperating with each nozzle, wherein each guide plate is provided with an opening portion open towards one of warp directions so as to form the above-mentioned guiding channel, and an air escaping passage is formed between every two adjacent guide plates in such a condition that the quantity of escaping air flow through each escaping passage is maximum at a predetermined portion of each escaping passage, for example, at a position corresponding to the innermost position of the opening portion of each guide plate. Consequently, the weft yarn introduced into the shed by the main nozzle can be carried through the shed in a desirable streightened condition toward the filing direction at desirable high speed by the controlled air jet streams flows through the guiding channel, so that any possibilitiy of the weft yarn escaping from the guiding channel, that is, any possibility of an incorrect filing operation, can be assuredly prevented.

The present invention will now be described by reference to embodiments illustrated in the accompanying drawings.

Figure 1:
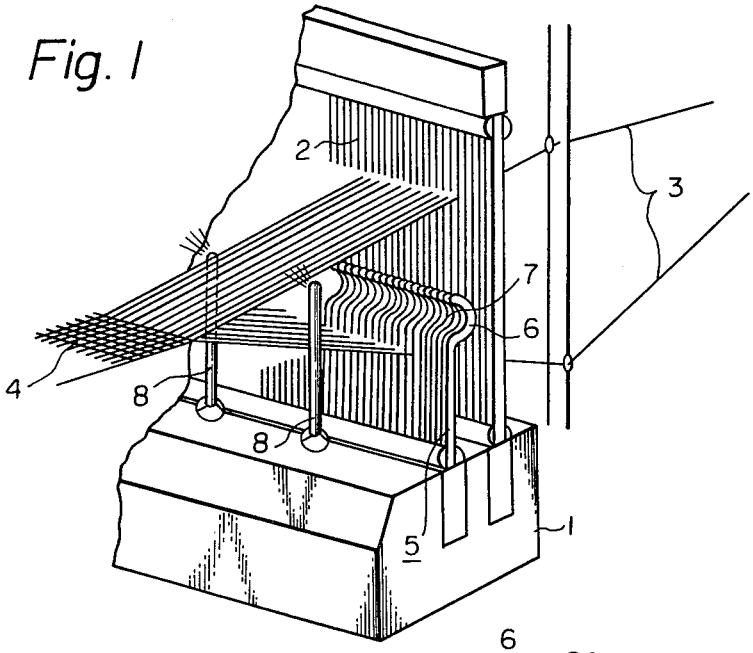
FIG. 1 is a schematic perspective view of the device for inserting a weft yarn into a shed formed on a jet operated weaving loom, according to the present invention.
Figure 2:
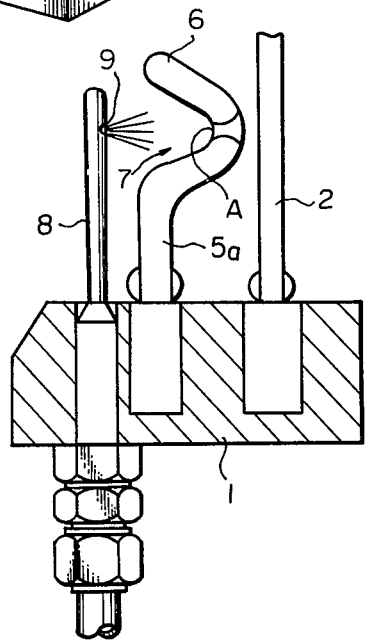
FIG. 2 is a schematic side view of a part of the weft inserting device illustrated in FIG. 1.

Referring to FIG. 1, which is a perspective view illustrating a part of the device for inserting the weft yarn according to the present invention, a slay 1 is swung by an appropriate drive mechanism (not shown) and a reed 2 is rigidly mounted to the slay 1 so as to beat up a weft yarn inserted in a shed formed by warp yarns 3. A comb 5 consisting of a plurality of guide plates 5*a* is also rigidly mounted on the slay 1 at a position between the reed 2 and the cloth-fell of a fabric 4, which is gradually woven, in a condition parallel to the reed 2. The guide plates 5*a* are substantially perpendicularly aligned on the slay 1 with a predetermined intervened space formed between the adjacent guide plates 5*a*, in other words, the guide plates 5*a* are substantially aligned along the weave-width direction and they work as guide members for fluid streams and a filling yarn carried by the respective fluid streams. In the embodiment illustrated in FIGS. 1 and 2 a guide passage 7 is formed by a curved portion 6 of each guide plate 5*a*, and is open to the side of the cloth-fell. More specifically, the curved portion 6 has such a curved face that both the upper and lower edges of the opening thereof extend toward the inside and meet each other at the innermost part of the opening. Therefore, it may be understood that the guide passage 7 extending in the filing direction is defined by the position of the curved portions 6 of the guide plates 5*a*. A plurality of auxiliary nozzles 8 are rigidly mounted on the slay 1, in an aligned condition along the reed 2, and are respectively positioned between the comb 5 and the cloth-fell. Each auxiliary nozzle 8 is connected to a common conduit connected to means for supplying compressed air thereto and is provided with an aperture 9 through which a compressed jet air is ejected toward the filling direction. In the above-mentioned alignment of the auxiliary nozzles 8, a predetermined interval is provided between two adjacent auxiliary nozzles 8 so that a fluid jet ejected from an opening 9 of any auxiliary nozzle 8 works to the yarn carrying along a part of the guide passage 7.

The filling system having the above-mentioned structure is the same as in the conventional techniques and the filling operation is carried out in the following manner. That is, a weft yarn is initially introduced into the shed of the warp yarns by means of a main device for introducing the filling yarn, such as a main nozzle (not shown), and thus introduced yarn is carried successively by fluid jet streams ejected from a first auxiliary nozzle 8*a*, next from a second auxiliary nozzle 8*b*, next from a third auxiliary nozzle 8*c* and so on, and finally, the filling of the weft yarn into the above-mentioned shed is completed. After the above-mentioned filling operation is completed, the slay 1 starts to swing toward the cloth fell and, since the guide plates 5*a* of the comb 5 and the auxiliary nozzles 8 are escaped from the shed the weft yarn remaining in the shed is beaten up to the cloth fell by the reed 2 so as to form the woven fabric. Thereafter, the slay 1 is swung to return to its rear-side terminal position of the swing motion thereof, the guide plates 5*a* and the auxiliary nozzles 8 being separated from the warp yarns by this swing motion.

FIGS. 2 to 5 illustrate one embodiment of the present invention. As will be apparent from FIG. 2, the layout of the reed 2, guide plates 5*a* which form the comb 5, and the auxiliary nozzles 8 in this embodiment is the same as illustrated in FIG. 1. Each guide plate 5*a* is provided with a curved portion 6 confronting an auxiliary nozzle 8 and, as hereinbefore explained, the curved portion 6 is defined by a curved face extending and expanding gradually from the innermost position A and is open on the side of the cloth-fell.

To attain the purpose of the present invention, it is very important to provide means for controlling the carrying action of the weft yarn, which is introduced into a shed, by individual pressurized air flows ejected from the auxiliary nozzles 8, in the device for picking weft yarns in shuttleless looms. One of the embodiments of this control means is hereinafter explained in detail with reference to FIGS. 2 to 5.

The above-mentioned control means comprises a plurality of guide plates 5*a*, which form a part of a guiding channel 7 for a weft thread periodically inserted in a shed, a corresponding one of the auxiliary nozzles 8, and an air escaping passage 5*b* formed between each of two adjacent guide plates in a condition that the quantity of escaping air flow through each of the escaping passages 5*b* is maximum at a predetermined portion of each escaping passage 5*b*. Therefore, the air stream ejected from the corresponding auxiliary nozzle 8 toward the guiding channel 7 partly escapes through the above-mentioned escaping passages 5*b*. To control the condition of the air flow escaping through the escaping passages 5*b* in such a desired condition that quantity thereof is maximum at each escaping passage 5*b* of the innermost positions A of the curved portions of the two adjacent guide plates 5*a*, the width of each guide plates 5*a* is narrowest at the above-mentioned innermost position A of each guide plate 5*a* and the width of the guide plate 5*a* gradually increases toward the two terminals of the curved portion 6 of each guide plate 5*a*.

Figure 3:
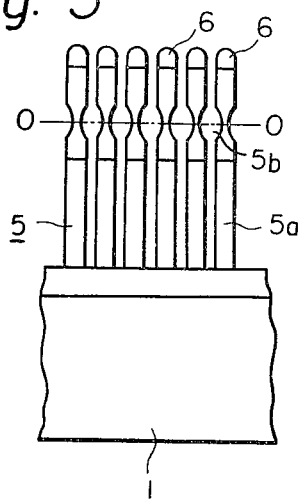
FIG. 3 is a schematic front view of a part of a comb provided with a plurality of guide plates illustrated in FIG. 1.
Figure 4:
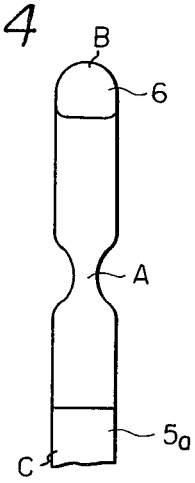
FIG. 4 is an enlarged front view of a guide plate illustrated in FIG. 1.
Figure 5:
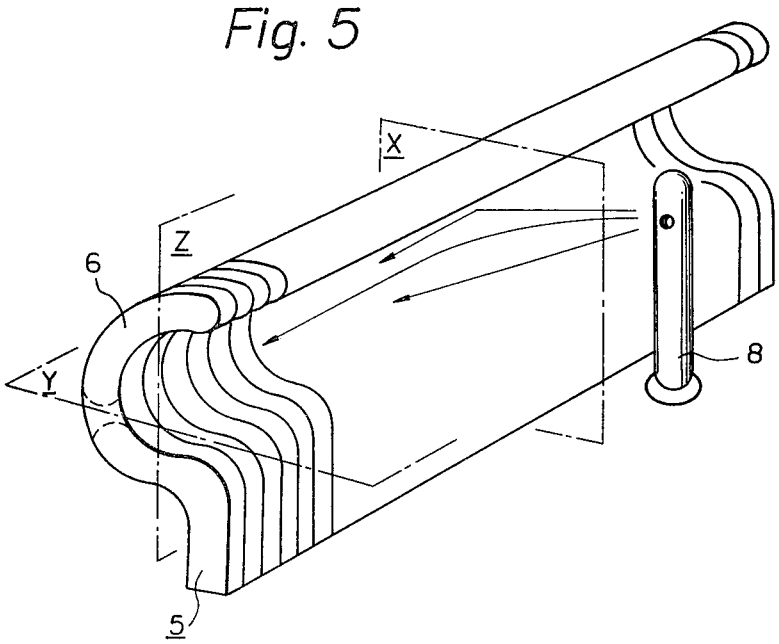
FIG. 5 is a schematic perspective view of a part of the comb and an auxiliary nozzle illustrated in FIG. 1.

Accordingly, when the curved face of the guiding channel 7 defined by the curved portions 6 of a number of the guide plates 5*a* is seen from the front side, as shown in FIG. 3, the escaping passage 5*b* formed between every two adjacent guide plates 5*a* is largest on the central line 0—0, where the innermost position of the guiding channel 7 is located, and the passage 5*b* gradually diminishes in the vertical direction, namely toward the edges of the curved face. When air flows through the escaping passage 5*b*, the fluid passes through the position of the central line 0—0 most easily because the flow resistance of the air flow passing through the passage 5*b* is lowest at the respective positions along the central line 0—0.

Figure 6:
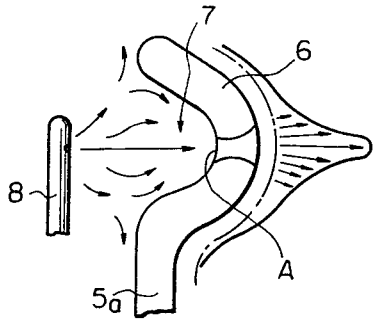
FIG. 6 is a diagematical representation of the flow condition of the air stream escaping through an escaping passage formed between two adjacent guide plates illustrated in FIG, 1.
Figure 7:
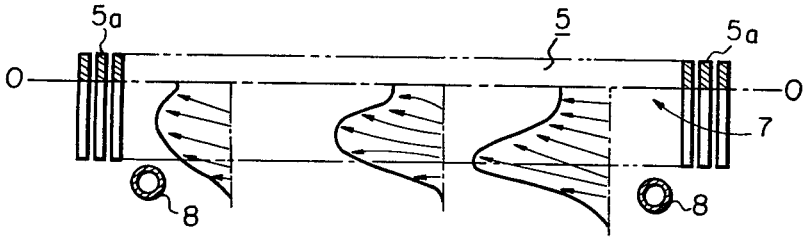
FIG. 7 is a diagramatical elevational view representation of the flow condition of the air jet stream flowing in the guiding channel formed by the comb illustrated in FIG. 1.
Figure 8:
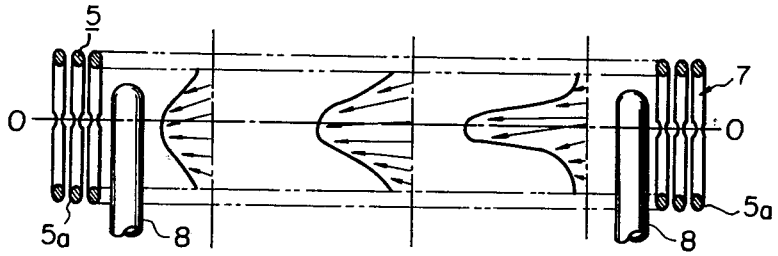
FIG. 8 is a diagramatical front view representation of the flow condition of the air jet stream flowing in the guiding channel formed by the comb illustrated in FIG. 1.

The above-mentioned flow resistance is gradually increased toward the edges of the curved face from the corresponding position of the central line 0—0, and therefore, passing of air through the passage 5b at such position approaching the above-mentioned edges is gradually inhibited. The air jetted from the auxiliary nozzle 8 diffuses with the lapse of time. Namely, the air is jetted while diffusing in a substantially conical form. Therefore, the air is blown toward the entire region of the curved face of the guiding channel 7. Since the passage 5b between every two adjacent guiding plates 5a is largest at the innermost position A of the curved portion and the flow resistance is low in the vicinity of the innermost position A as pointed out hereinbefore, the jetted air stream which arrives at the vicinity of the innermost position A of the curved face is readily allowed to escape to the outside from the respective passages 5b. However, the escaping of the air stream, which arrives at the vicinity of the curved face of the guiding channel 7 in a portion other than the innermost portion A, from the passage 5b, is restricted because in this portion the each passage 5b between every two guide plates 5a is small and the flow resistance is high. The velocities of the air flowing outwardly from respective portions of each passage 5b between every two adjacent guide plates 5a were measured and the flow velocity distribution was examined. The thus obtained result is diagamatically represented in FIG. 6. In FIG. 6, it is seen that the flow velocity is highest in the vicinity of a position corresponding to the central line 0—0 of the curved face of the guiding channel 7 (see FIG. 3) and the flow velocity is abruptly lowered at positions apart from the position corresponding to the central line 0—0. FIGS. 6 to 8 illustrate the flowing state of the air jetted from the auxiliary nozzles 8 in the guiding channel 7, which is observed when the operation of the weft yarn insertion is carried out in the above-mentioned construction where the guide member, that is the comb 5 constructed by the guide plates 5a, is combined with the auxiliary nozzles 8 and mounted on the sley 1. It should be noted that FIGS. 6, 7 and 8 illustrate this flowing state as seen from planes A, B and C, respectively, indicated in FIG. 5. A part of the air stream which arrives at the vicinity of the position corresponding to the central line 0—0 flows out through the escaping passage 5b between every two adjacent guide plates 5a and the remainder flows in the filling direction. The majority of the air stream that arrives at the curved face at portions other than the position corresponding to the central line 0—0 flows in the filling direction, because a very minor part thereof flows out as the leakage air. However, since flow-out of the air in the vicinity of the central line 0—0 is very violent and there is caused a pressure difference, the air jetted to the edge portion of the curved face as a whole forms a stream flowing toward the central line 0—0. Accordingly, the majority of the air that arrives at the curved face, except the leakage air, tends to flow concentratedly toward the vicinity of the central line 0—0 and the majority of the air jetted from the auxiliary nozzle 8 forms a convergent stream flowing in the filling direction. Further, since the guiding channel 7 is defined by the curved faces of the guide plates 5a no turbulent flow of the air is generated in the edge portion of the curved face, and the majority of air jetted from each auxiliary nozzle 8 tends to flow smoothly and stably toward the central line 0—0.

As will be apparent from the above-mentioned explanation, the air jetted from each auxiliary nozzle 8 tends to focus in the vicinity of the central line 0—0 of the guiding channel 7 by the flow of the air per se and tends to flow toward the filing direction in the form of such convergent stream. Accordingly, the weft yarn inserted by the air stream jetted from the main nozzle (not shown) receives the influence of the air stream jetted from the auxiliary nozzles 8. More specifically, while the weft yarn receives a restraint force toward the vicinity of the central line 0—0 by air stream flowing to the vicinity of the central line 0—0 from the peripheral region of the curved face, the weft yarn is caused to fly in the filing direction by a propelling force of this air stream. In this manner, the weft yarn introduced into the shed by the air stream jetted from the main nozzle (not shown) is always restrained toward the innermost position of the curved face by the air jetted from the respective auxiliary nozzles 8 while the weft yarn is flying in the guiding channel 7, and in this state, the weft yarn is propelled in the filing direction. Accordingly, the weft yarn can be effectively prevented from flying out from the guiding channel 7 and the operation for inserting a weft yarn into the shed can be performed very stably. Furthermore, as mentioned above, the air jetted from the auxiliary nozzles 8 exerts a function of holding and restraining the weft yarn at the innermost position in the guiding channel 7 by the convergent air stream and, thus, stabilizes the inserting condition of the weft yarn. Accordingly, the resistance caused by impinging contact of the weft yarn with the guide member can be remarkably diminished.

Figure 9:
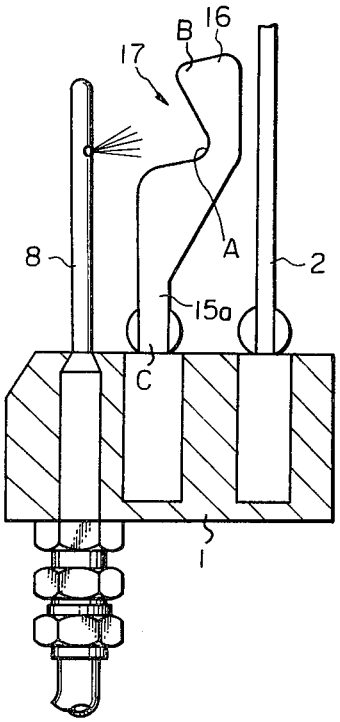
FIG. 9 is a schematic side view of a part of the other embodiment of the weft insertion decice according to the present invention.
Figure 10:
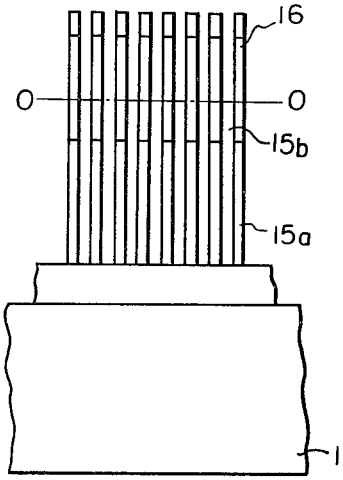
FIG. 10 is a schematic front view of a part of the comb illustrated in FIG. 9.
Figure 11:
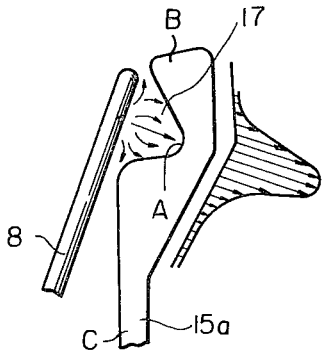
FIG. 11 is a diagramatic representation of the flow condition of the air stream escaping through an escaping passage formed between two adjacent guide plates illustrated in FIG. 9.

FIGS. 9 to 11 illustrate other embodiments of the present invention, in which the basic technical concept is the same as in the above-mentioned first embodiment. Referring to FIGS. 9 and 10 a reed 2 is rigidly mounted on the slay 1, and a comb 15 constructed by plurality of guide plates 15a is rigidly mounted to the slay 1 at a position between the reed 2 and the cloth fell of the woven fabric (not shown). A guiding channel 17 open to the side of the cloth fell is defined by curved portions 16 of the guide plates 15a. Auxiliary nozzles 8 are arranged at predetermined intervals to confront the guiding channel 17. The means for controlling the carrying action of the weft yarn by individual pressured air flows ejected from the auxiliary nozzles 8 applied for this embodiment illustrated in FIG. 9 is different from the first embodiment illustrated in FIGS. 2 to 5. More specifically, in the embodiment illustrated in FIGS. 9 to 11, the width the cross-section of each guide plate 15a in the filling direction of each guide plate 15a is identical as shown in FIG. 10, but the width of the cross-section thereof in the beating up direction of the loom is changed so as to partly change the flow resistance of the air flow passing through each escaping passage 15b formed between two adjacent guide plates 15a. A plurality of guide plates 15a are aligned in parallel substantially along the reed 2, and the guiding channel 17 is defined by curved portions 16 of the guide plates 15a. The central line 0—0 indicates the innermost position of the curved face of the guiding channel 17. In each guide plate 15a, the width of the cross-section thereof taken along the beating up direction of the loom is smallest at the part A which corresponds to the central line 0—0, and this width is abruptly increased from the central line 0—0 toward the tip end B and the base and C thereof. When the above-mentioned width of each guide plate 15a is thus changed, the flow distance of the air stream passing between the escaping space 15b toward the reed 2 is changed among respective portions of the guide plate 15a. More specifically, if the length of the air stream contacting the side face of the guide plate 15*a* is relatively longer, the flow resistance by the side face of the guide plate 15*a* becomes relatively larger.

FIG. 11 illustrates the distribution of the velocities of the air stream escaping through the escaping passage 15*b* in the case of the embodiment shown in FIG. 9. Also in the second embodiment, the flow resistance between every two adjacent guide plates 15*a* is smallest in the vicinity of the position corresponding to the central line 0—0 of the curved face and escaping air stream through the escaping passage 15*b* is most prominent in that portion. This phenomenon of the escaping air stream through the escaping passage 15*b* is quite similar to the first embodiment of the present invention. Accordingly, at positions of the escaping passage 15*b* located away from the central line 0—0, the flow resistance is increased and the air is hardly allowed to escape through those portion of the escaping passage 15*b*, and consequently, the quantity of air escaping those portions is abruptly decreased. In the vicinity of the central line 0—0 where the flow resistance is lowest and the escaping of the air is most prominent, a so-called negative pressure state is brought about, and the fluid in other portions of a high flow resistance is caused to tend to flow toward the vicinity of the central line 0—0. Furthermore, since the air from the auxiliary nozzles 8 is jetted in the filling direction, as illustrated in FIGS. 7 and 8 with respect to the first embodiment, the fluid tends to focus toward the vicinity of the central line 0—0 and flows in the filing direction in the form of a convergent stream. In the case where each guide plate 15*a* is provided with the structure illustrated in FIGS. 9 to 11, the condition of the speed distribution of escaping air, illustrated in FIG. 11 through each escaping passage 15*b* is not changed even if the intervened gap between two adjacent guide plates 15*a* is changed, but the flow amount of the escaping air is changed depending on the size of the gap. Therefore, when these guide plates 15*a* are arranged, in order to attain a desired state of escaping air through each escaping passage 15*b*, it is necessary to adjust the gap between every two adjacent guide plates 15*a*. In the second embodiment, this can be sufficiently attained by mounting the guide plates 15*a* independently on the slay 1.

As will be apparent from the above explanation, even if the guide plates 15*a* are constructed and arranged as illustrated in FIGS. 9 to 11, the weft yarn introduced into a shed can be always restrained and held stably in the vicinity of the central line 0—0 by the air stream which tends to focus toward the vicinity of the central line 0—0 of the curved face of the guiding channel 17.

Figure 12:
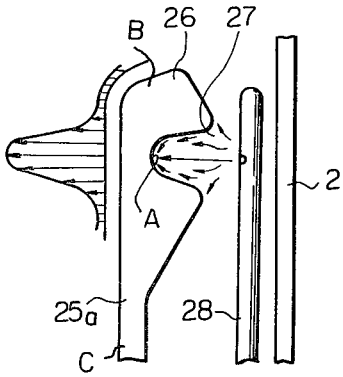
FIG. 12 is a schematic side view of a part of still another embodiment of the weft insertion device according to the present invention, wherein the flow condition of the air stream escaping through an escaping passage formed between two adjacent guide plates is diagramatically illustrated.

Referring to FIG. 12, illustrating still another embodiment of the present invention wherein a comb composed of a plurality of guide plates 25*a* is utilized, the resistance to the escaping air stream through each escaping passage formed between every two adjacent guide plates 25*a* by the side faced of the respective guide plates 25*a* varies in substantially same condition as the above-mentioned second embodiment illustrated in FIG. 9 to 11. However, the guide plates 25*a* of this embodiment are different from those of the second embodiment illustrated in FIGS. 9 to 11 with respect to a curved portion 26. More specifically, the curved portion 26 of each guide plate 25*a* is open to the side of the reed 2, and the corresponding auxiliary nozzle 28 is disposed between the guide plate 25*a* and the reed 2. In this manner, the auxiliary nozzles 28 are aligned in the weave width direction at predetermined intervals. In this third embodiment, since the weft yarn is readily allowed to escape from the guiding channel 27 during the swing motion of the slay 1 toward the cloth-fell for carrying out the beating motion, the guiding channel 27 can be formed in a more closed state and hence, the cross-sectional shape of the guide plate 25*a* in the warp direction of the loom can be designed more freely compared to the above-mentioned first and second embodiments so that a most desirable state of the flow resistance imparted, by the side faces of each guide plate 25*a* can be easily established. For example, in the case of guide plates 15*a* illustrated in FIGS. 9 to 11, since the curved portion 16 is open to the side of the cloth-fell, when the guide plates 15*a* are going to escape from the shed outwardly when the beating motion is carried out, the guide plage 15*a* possibly hold the inserted weft yarn therein. In order to prevent this undesirable action of the guide plates 15*a*, it is necessary that the guiding channel 17 should be open at a relatively large angle. Therefore, in the guide plates 15*a*, the cross-sectional width of each guide plate 15*a* in the warp direction of the loom is limited to some extent. In contrast, in the third embodiment illustrated in FIG. 12, since the curved portion 26 is open to the side of the reed 2, when the beating motion is carried out, the guide plates 25 swing in such a direction as will release the inserted weft yarn therefrom. Accordingly, the above-mentioned restriction on the guide plates 15*a* utilized for the second embodiment illustrated in FIGS. 9 to 11 need not be taken into account. Consequently, the guiding channel 27 may be formed in a more closed condition compared to the above-mentioned first and second embodiments and the cross-sectional width of the guide plates 25 in the warp direction of the loom can be chosen relatively freely. As a result, the flow resistance imparted by the side faces of each guide plate 25*a* can be freely adjusted so as to attain a desirable condition of the escaping air stream.

When air is jetted into the guiding channel 27, which is defined by the curved portions 26 of the guide plates 25*a* of the comb 25 having the above-mentioned structure, from the auxiliary nozzle 28, as illustrated in FIG. 12, the flow resistance is smallest in the vicinity of the central line O—O of the curved face of the guiding channel 27 and therefore, leakage of the fluid through an escaping passage between every two adjacent guide plates 25*a* is most prominent in the vicinity of the central line O—O. At positions located away from the central line O—O, the flow resistance is gradually increased and quantity of air escaping through each escaping passage between every two adjacent guide plates 25*a* is decreased. Accordingly, the distribution curve of the speed of air escaping through the above-mentioned escaping passage is substantially the same as the curves in the above-mentioned first and second embodiments, and in the guiding channel 27, the fluid flows in the filling direction in the form of a stream focussing toward the central line O—O. Accordingly, also in the third embodiment illustrated in FIG. 12, each weft yarn can be stably held in the innermost portion of the guiding channel 27 so that the weft yarn can be carried in the filling direction under a strong propelling force.

In the above-mentioned three embodiments, it is possible to attain a more effective control of the carrying condition of the weft yarn in the guiding channel 7, 17, 27 by a method in which corresponding side faces of the respective guide plates 5, 15, or 25 are subjected to an appropriate surface treatment or by attaching members increasing the flow resistance to desirable positions on the side surfaces of each guide plate, so as to change the distribution of the flow resistance.

As will be apparent from the above explanation, according to the present invention, guide plates having curved portions which define the guiding channel of the comb extending in the weave width direction, and corresponding auxiliary nozzles are mounted on the slay in two alignments parallel to the reed, in such condition that the quantity of air escaping through each escaping passage formed between every two adjacent guide plates is positively increased in the innermost portion of the opening of the guiding channel formed by the comb, while the quantity of air escaping through the above-mentioned escaping passage at the portions corresponding to the edge portions of the opening of the guide channel is intentionally reduced. Consequently, the major portion of the air stream jetted from a corresponding auxiliary nozzle is intentionally concentrated in the filling direction. In other words, the above-mentioned major portion of the air stream is focused toward the predetermined portion of the guiding channel so that the weft yarn firstly introduced into the shed by the main nozzle can be held by the above-mentioned focused air stream in a stable condition. By virtue of the above-mentioned characteristic structural feature of the present invention, even if the guide plates of the comb, are widely open toward the side of the cloth-fell or the side of the reed, when the operation for inserting a weft yarn into a shed is carried out, the weft yarn can be stably held and restrained in the desirable position in the guiding channel by the major portion of the air stream jetted from the respective auxiliary nozzles, which air stream is focussing toward the intended position in the guiding channel, and therefore, the carrying motion of the weft yarn is controlled to fly the weft yarn in the filling direction. Further, since the weft yarns are always kept in the stable condition, the resistance by impinging or contacting the weft yarns with the guide member is remarkably decreases, and failure of the weft inserting operation caused by the escaping of the weft yarn from the guiding channel or the catching of the weft yarn on the auxiliary nozzle or guide plate can be assuredly prevented.

What is claimed is:

1. In a jet operated weaving machine provided with a mechanism for forming a shed of warp yarns, a reed for beating up a weft yarn inserted into said shed periodically, a slay for supporting said reed, a device for inserting a weft yarn through said shed comprising a main nozzle for picking up and carrying said weft yarn through at least part of the length of said shed and a comb forming a guiding channel for said weft yarn upon being periodically inserted in said shed, said comb comprising a plurality of guide plates arranged in an aligned condition parallel to the longitudinal direction of said reed, each of said guide plates having an opening portion, said guiding channel being formed by said opening portions of said guide plates, a plurality of auxiliary nozzles arranged in an aligned condition parallel to said comb for directing a plurality of individual pressure fluid flows into said guiding channel, means for controlling the carrying action of said weft yarn by said individual pressure fluid flows started from each of said auxiliary nozzles comprising in combination a plurality of said guide plates and a corresponding one of said auxiliary nozzles, and an air escaping passage formed between every two adjacent guide plates and defined by the shape of the region therebetween, each said region having an enlarged portion for reducing the flow resistance of the air escaping from the corresponding nozzle in the direction of said warp yarns, so that the quantity of the escaping air flow through each escaping passage is maximum at a predetermined portion of said escaping passage.

2. A device for inserting a weft yarn through a shed formed on a jet operated weaving machine according to claim 1, wherein said opening portion of each of a predetermined number of guide plates opens toward the side of said reed.

3. A device for inserting a weft yarn through a shed formed on a jet operated weaving machine according to claim 1, wherein said opening portion of each of a predetermined number of guide plates opens toward the side of cloth fell.

4. A device for inserting a weft yarn through a shed formed on a jet operated weaving machine according to claim 1, wherein said auxiliary nozzle is provided with an aperture for directing pressurized fluid flow toward a direction which coincides with a neutral line of said guiding channel.

5. A device for inserting a weft yarn through a shed formed on a jet operated weaving machine according to claim 1, wherein at least the opening portion of each of a predetermined number of said guide plates confronting each one of said auxiliary nozzles has a relatively wide outside opening such that the upper portion of each corresponding auxiliary nozzle meets the opening portion of said guide plate in a face to face relation, whereby the pressurized fluid from each auxiliary nozzle is freely and directly injected into each corresponding guide channel.

6. A device for inserting a weft yarn through a shed formed on a jet operated weaving machine according to claim 1, wherein each of a predetermined number of said guide plates is provided with a curved face, and the thickness of each guide plate in a longitudinal direction of said comb is narrowest at an innermost position of said curved face, so that the quantity of the escaping air flow through each escaping passage is maximum at a position corresponding to said innermost position of said curved face.

7. A device for inserting a weft yarn through a shed formed on a jet operated weaving machine according to claim 6, wherein said curved face of said predetermined number of guide plates opens toward the side of cloth fell.

8. A device for inserting a weft yarn through a shed formed on a jet operated weaving machine according to claim 7, wherein the thickness of each of said predetermined number of guide plates gradually increases from said innermost position toward both terminals of said curved face.

9. A device for inserting a weft yarn through a shed formed on a jet operated weaving machine according to claim 8, wherein a tip part of said each of said predetermined number of guide plates comprises a curve portion having a curved face.

10. A device for inserting a weft yarn through a shed formed on a jet operated weaving machine according to claim 1, wherein each of a predetermined number of said guide plates is provided with a recess, and the width of each of said predetermined number of said guide plates along a direction of warp yarns is the narrowest at an innermost position of said recess, so that the quantity of the escaping air flow through each escaping passage is maximum at a position corresponding to said innermost position of said recess.

11. A device for inserting a weft yarn through a shed formed on a jet operated weaving machine according to claim 10, wherein said recess of said each of said predetermined number of guide plates opens toward the side of cloth fell.

12. A device for inserting a weft yarn through a shed formed on a jet operated weaving machine according to claim 11, wherein the width of each of said predetermined number of guide plates gradually increases from said innermost position toward both terminals of said recess.

13. A device for inserting a weft yarn through a shed formed on a jet operated weaving machine according to claim 12 wherein each of said predetermined number of guide plates comprises a plate having a V-shaped recess at a tip portion thereof and an identical thickness.

14. A device for inserting a weft yarn through a shed formed on a jet operated weaving machine according to claim 13, wherein the tip portion of each said auxiliary nozzle is provided with a predetermined angle to the longitudinal axis of each corresponding guide plate.

15. A device for inserting a weft yarn through a shed formed on a jet operated weaving machine according to claim 10, wherein said recess of said each of said predetermined number of guide plates opens toward the side of said reed.

16. A device for inserting a weft yarn through a shed formed on a jet operated weaving machine according to claim 15, wherein the width of each of said predetermined number of guide plates gradually increases from said innermost position toward both terminals of said recess.

17. A device for inserting a weft yarn through a shed formed on a jet operated weaving machine according to claim 16, wherein each of said predetermined number of guide plates is provided with a U-shaped recess formed at a tip portion thereof and having an identical thickness.

18. A device for inserting a weft yarn through a shed formed on a jet operated weaving machine according to claim 10, wherein the distance between any two adjacent guide plates is identical.

19. A device for inserting a weft yarn through a shed formed on a jet operated weaving machine according to claim 10, wherein the thickness of each of said predetermined number of guide plates in a longitudinal direction of said comb is thinnest at said innermost position of said recess so that the quantity of the escaping air flow through said escaping passage is maximum at said innermost position thereof.

20. In a jet operated weaving machine provided with a mechanism for forming a shed of warp yarns, a reed for beating up a weft yarn inserted into said shed periodically, a slay for supporting said reed, a device for inserting a weft yarn through said shed comprising a main nozzle for picking up and carrying said weft yarn through at least part of the length of said shed and a comb forming a guiding channel for said weft yarn upon being periodically inserted in said shed, said comb comprising a plurality of guide plates arranged in an aligned condition parallel to the longitudinal direction of said reed, each of said guide plates having an opening portion, said guiding channel being formed by said opening portions of said guide plates, a plurality of auxiliary nozzles arranged in an aligned condition parallel to said comb for directing a plurality of individual pressure fluid flows into said guiding channel, means for controlling the carrying action of said weft yarn by said individual pressure fluid flows started from each of said auxiliary nozzles comprising in combination a plurality of said guide plates and a corresponding one of said auxiliary nozzles, and an air escaping passage formed between every two adjacent guide plates so that the quantity of the escaping air flow through each escaping passage is maximum at a predetermined portion of said escaping passage, each guide plate being provided with a curved face, and the thickness of each guide plate in a longitudinal direction of said comb being narrowest at an innermost position of said curved face, so that the quantity of the escaping air flow through each escaping passage is maximum at a position corresponding to said innermost position of said curved face.

* * * * *

UNITED STATES PATENT AND TRADEMARK OFFICE

CERTIFICATE OF CORRECTION

PATENT NO. : 4,244,402

DATED : January 13, 1981

INVENTOR(S) : Junzo Hasegawa et al.

It is certified that error appears in the above—identified patent and that said Letters Patent is hereby corrected as shown below:

Column 1, line 12: "clasified" should be -- classified --.

Column 1, line 45, Column 2, line 53, Column 3, line 40 and Column 4, line 35: "streightened", each occurrence, should be -- straightened --.

Column 3, line 30: "assureadly" should be -- assuredly --.

Column 4, line 22: Delete "the" before "auxiliary nozzles --.

Column 4, line 57: "diagematical" should be -- diagrammatical -.

Column 4, lines 61 and 65 and Column 5, lines 6 and 15: "diagramatical" should be -- diagrammatical --, each occurrence.

Column 5, line 2: "decice" should be -- device --.

Column 5, line 65: Add -- the -- before "thus".

Column 7, line 25: "diagramatically" should be -- diagrammatically --.

UNITED STATES PATENT AND TRADEMARK OFFICE

CERTIFICATE OF CORRECTION

PATENT NO. : 4,244,402

DATED : January 13, 1981

INVENTOR(S) : Junzo Hasegawa et al.

It is certified that error appears in the above—identified patent and that said Letters Patent is hereby corrected as shown below:

Column 7, line 68, Column 8, lines 9 and 16 and Column 9, line 29;

"filing", each occurrence, should be -- filling --.

Signed and Sealed this

*Twenty-first* Day of *July 1981*

[SEAL]

*Attest:*

GERALD J. MOSSINGHOFF

*Attesting Officer*

*Commissioner of Patents and Trademarks*